US005153367A

United States Patent [19]

Markquart et al.

[11] Patent Number: 5,153,367

[45] Date of Patent: Oct. 6, 1992

[54] COCOON LAUNCHER AND STORAGE SYSTEM

[75] Inventors: Fred A. Markquart, Maple Grove; Lowell R. Larson, Anoka; Gregory E. Hannasch, Coon Rapids; Paul R. Gottwaldt, Andover; Terry J. Walton, St. Paul, all of Minn.

[73] Assignee: FMC Corporation, Chicago, Ill.

[21] Appl. No.: 762,513

[22] Filed: Sep. 17, 1991

[51] Int. Cl.[5] ..... F41A 1/04

[52] U.S. Cl. ..... 89/1.816; 89/1.8

[58] Field of Search ..... 89/1.816, 1.817, 1.8

[56] References Cited

U.S. PATENT DOCUMENTS

| | | | |
|---|---|---|---|
| 4,429,611 | 2/1984 | Oldham et al. | 89/1.816 |
| 4,470,336 | 9/1984 | Swann et al. | 89/1.816 |
| 4,471,684 | 9/1984 | Johnson et al. | 89/1.8 |
| 4,556,438 | 12/1985 | Hoffmeister et al. | 89/1.816 |

*Primary Examiner*—David H. Brown

*Attorney, Agent, or Firm*—Michael Lee; R. B. Kamp

[57] ABSTRACT

The invention provides a cocoon/launcher for encanistered missiles. The cocoons provide environmental protection and temperature and humidity control for the encanistered missiles. The cocoon/launcher with its mechanical/electrical and conditioned air interface also provides a flexibility that allows missiles to be launched from a variety of ships and locations on ships.

13 Claims, 3 Drawing Sheets

FIG_5
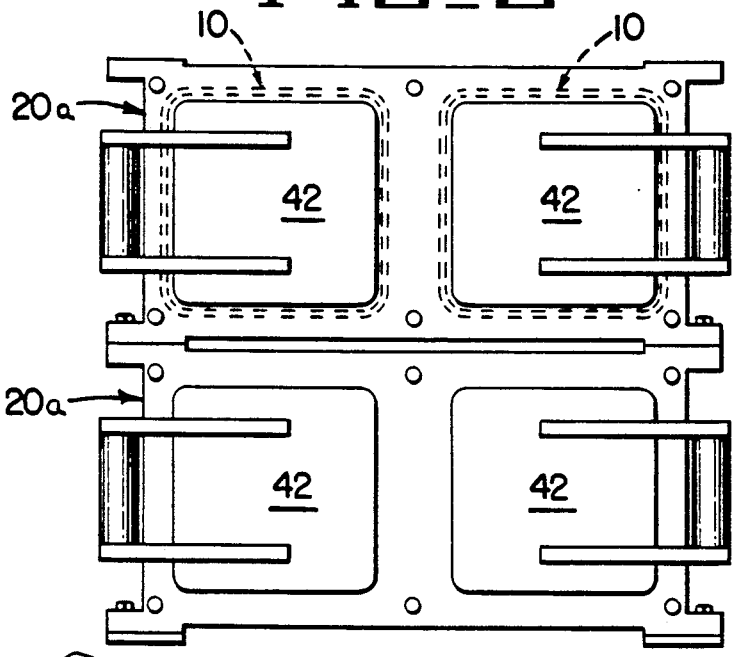
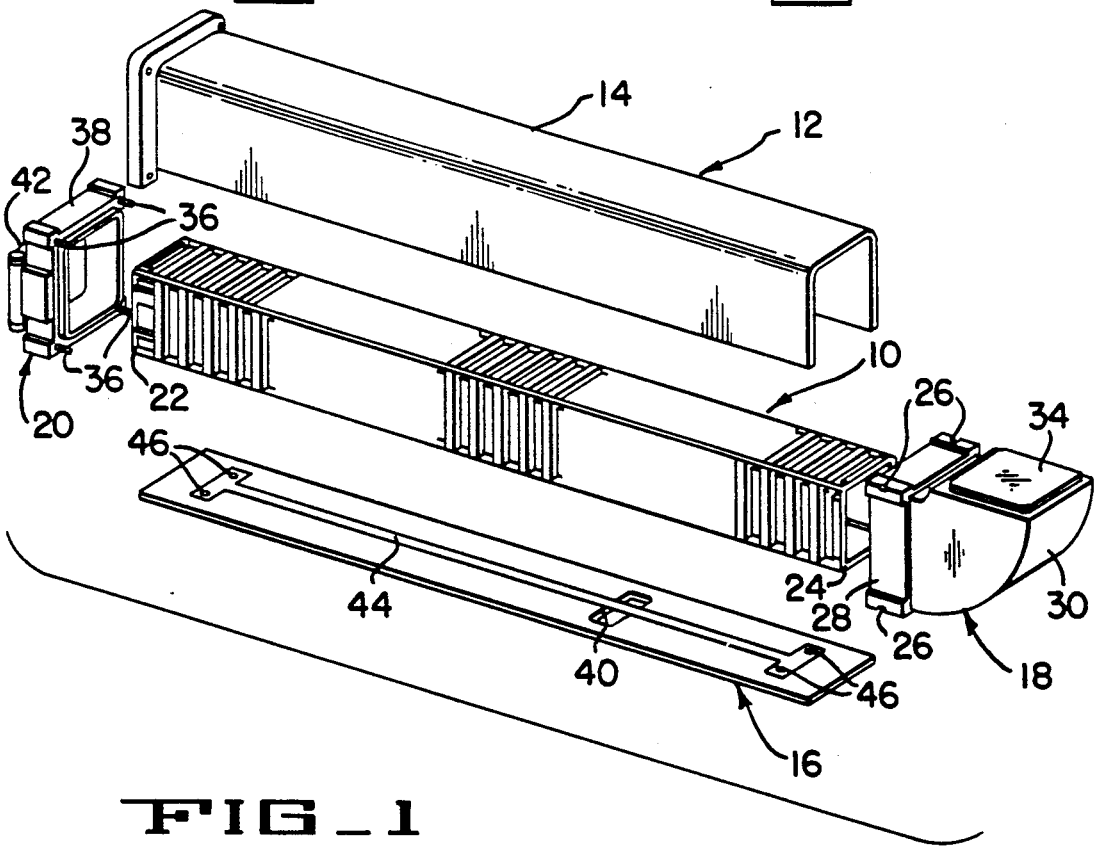
FIG_1

10
12
14
16
18
20
22
26
28
30'
34
36
38
40
42
44
48
50
52
54
56
58
64
66
68
70
4

COCOON LAUNCHER AND STORAGE SYSTEM

This invention generally relates to an apparatus that allows externally mounted launching of missiles from a ship. The Mk41 vertical launching system allows for the launching of various missiles from various ships. This launching system utilizes canisters in which missiles are stored, shipped, and launched. The canisters provide walls which surround the sides of the missiles, but where often the top and bottom of the canisters are open after missile firing. In addition the canisters provide an electrical interface between the missile and the launcher and a mechanical interface between the missile and the launcher. Such canisters produced by FMC Corporation TM which are used by the Mk 41 vertical launch system are the Mk 13 vertical launching system canisters, which accommodate the SM-2 missile, the Mk 14 canisters, which accommodate the TOMAHAWK missile, and Mk 15 canisters, which accommodate vertical launch ASROC anti-submarine missiles and the Mk 22 canister which accommodates the Seasparrow missile. These canisters as used in the prior art were designed for short term exposure to the environment during shipping and transportation but were not designed for exposure to an external naval environment. Prior art launchers, such as the Mk 41 vertical launch system, utilizing the canisters were mounted below the deck of the ship partly to provide the necessary environmental protection of the canisters, their electrical connections and the missiles. The below deck area provided by the ship for the Mk 41 protects the canisters from corrosive salt water and humidity, and is required by some missiles for temperature control for proper operation to be launched. Because the launcher is mounted below the deck of the ship, an exhaust system is needed to vent the exhaust of the missiles as they are launched. The exhaust from one missile as it is launched may affect adjacent missiles if the missiles are launched to close together. In addition, launchers mounted below the deck are expensive and inflexible and impossible to install on some ships, limiting the ships from which the encanistered missiles can be launched. However, much time and money has been expended by the U.S. Navy to develop canisters and qualify them for use as missile containers for storage handling, transportation, shock, interface, and launcher guidance of various missiles for use in the Mk 41 launching systems. Some missiles are currently available for launch only in one of these canisters. Further, several new missiles are being integrated into new canisters also for the Mk 41 launcher.

The invention provides an alternate method and apparatus for storing and launching missiles. The invention provides a cocoon which encloses the canister of the missile. The cocoon system provides the environmental protection for the encanistered missiles and allows the missiles to be launched from an environmentally unprotected part of a ship or from land. The cocoon provides environmental protection and allows for operational temperature and humidity control for the canister and missile, a physical interface, and alignment and support to the ship. The invention provides a method for interfacing to an actual or modified Mk 41 control system.

FIG. 1 provides an exploded perspective view of the inventive cocoon and a missile canister.

FIG. 2 provides a partially cut away view of cocoons mounted to form a topside launcher.

FIG. 3 provides a perspective view of the protective boot in FIG. 2.

FIG. 5 is a top view of another embodiment of a launcher.

Figures 2, 3:
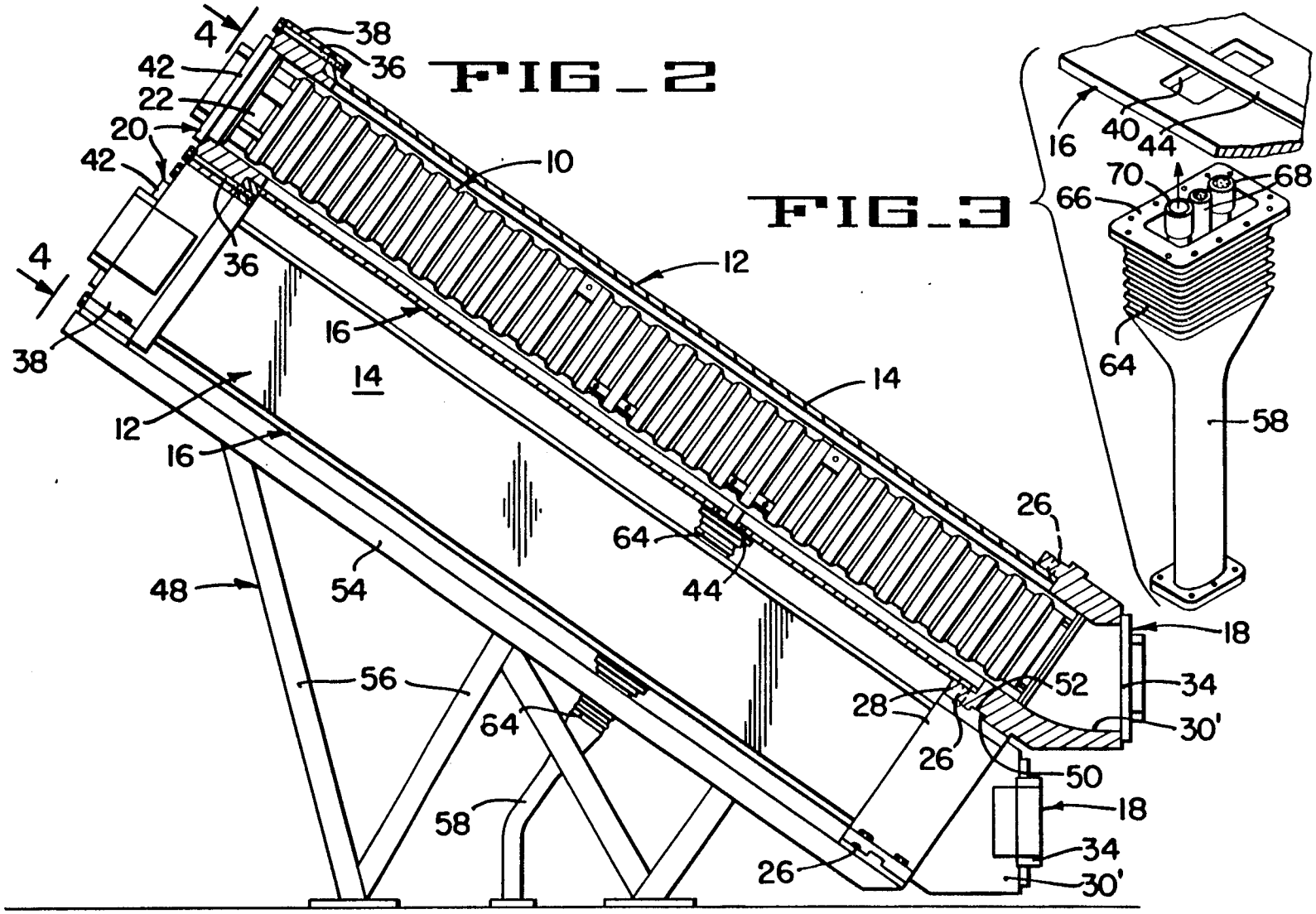

In the preferred embodiment a canister 10 is surrounded by a cocoon 12, comprising a U-shaped upper section 14, a semi-flat lower section 16, an aft fixture 18, and a forward end fixture 20. The canister 10 houses a missile and comprises first, second, third, and fourth side walls and electrical connections for missile interfaces. The canisters may be open at the forward end 22 of the canister 10 and the aft end 24 of the canister. The canister 10 could be a Mk 15, Mk 13, or Mk 14 vertical launching system canister used in the prior art.

Wedge shaped lugs driven in by screws 26 are used to attach the aft fixture 18 to the aft end 24 of the canister. Other means may be used to mechanically attach the aft fixture 18 to the aft end 24 of the canister 10. The aft fixture 18, comprises a frame 28 for attaching to the canister 10, a deflector 30, and a door 34. The deflector 30 is a conduit for exhaust, wherein the conduit bends to change the direction of the flow of exhaust. The door 34 is set to open when exhaust passes through the deflector 30. Other embodiments replace the door 34 with a rubber or pliable break away cover, which breaks away when exhaust passes through the deflector 30. In this embodiment the deflector 30 changes the direction of the exhaust 90°. In other embodiments, the deflector may not be needed or would change the direction of the exhaust from any angle between 0° and 90° or more.

Bolts 36 are used to attach the forward end fixture 20 to the ends of the U-shaped upper section 14 and the lower section 16, which are adjacent to the forward end 22 of the canister 10. Other means may be used to mechanically attach the forward end fixture 20 to the U-shaped upper section 14 and the lower section 16. The forward end fixture 20 comprises a frame 38 for supporting the forward end of the canister 10 and a door 42. The door 42 is hinged to open to allow the missile to pass upon launching. Other embodiments may replace the door with a break away cover.

Extending from the aft fixture 18 to the forward end fixture 20 is the U-shaped upper section 14, which covers three sides of the canister 10 and which is mechanically (attached) connected to the aft fixture 18 and the forward end fixture 20. The U-shaped upper section 14 is designed to provide a space between the U-shaped upper section 14 and the canister 10 walls. Also extending from the aft fixture 18 to the forward end fixture 20 is the semi-flat lower section 16, which covers the fourth side of the canister 10 and is mechanically connected to the aft fixture 18, the forward end fixture 20, and the U-shaped upper section 14.

The semi-flat lower section 16, is designed to provide a space between the semi-flat lower section 16 and the canister 10 walls. The semi-flat lower section 16 has at least one aperture 40 to provide access for electrical wiring and air circulation. On the inside of the semi-flat lower section is a duct 44 with an inlet, not shown, at the aperture 40, and with a plurality of outlets 46 near the forward end 22 and the aft end 24 of the canister 10.

With the use of an air exchanger the cocoon 12 in conjunction with ship supplied conditioned air is able to protect the missile, missile canister 10, and electrical connections from heat, cold, salt water and other elements. The cocoon 12 could be made of a hardened metal or a high strength composite material to provide ballistic protection or this protection could be provided in the form of add on shields or aprons. Also material which would provide stealth features could be applied to the outside of the cocoon 12. The cocoon 12 may also be insulated to help reduce heat transfer. Since the cocoons 12 provide such protection to the canisters 10 and missiles, the canisters 10 and missiles in a cocoon 12 can be stored on the ship deck or in other places exposed to the elements. The end frames and doors may also contain electrical anti-icing heating to ensure door operation in icing conditions.

FIG. 2 illustrates four cocoons 12 stacked together and set on a support device 48, which sets the cocoons 12 at an angle to allow the missiles to be launched at an angle. This side view illustrates how the frame 28 of the aft fixture 18 has a groove 50 and a tongue 52. The tongue 52 and groove 50 allow the adjacent cocoons 12 to be connected together allowing the cocoons 12 to be stacked and allow the cocoons to be connected to the support device 48 or the deck of a ship. In this embodiment, the deflector 30' provides a 45° bend.

The support device 48 comprises a platform 54 connected to the cocoons 12 for holding the cocoons 12 at a desired angle, a platform support 56 connected to the platform 54 for holding the platform 54 at a desired angle, and a protective boot 58 for providing a passage for electrical wiring between the launcher controls and the missile and a passage for a conditioned air conduit. The protective boot 58 is connected to the aperture 40 of the cocoon 12. The boot 58 has a tubular shape and is made of a flexible material, and part of the protective boot 58 is accordion shaped as shown in FIGS. 2 and 3 or othewise collapsible, so the boot can be pulled away from the canister in its mounted position to allow connections to be made and then pushed against the canister, so that the boot 58 can be mounted flush to the semi flat lower section 16 at the aperture 40, providing a seal around the aperture 40. FIG. 3 is a more detailed view of the protective boot 58 with a flexible accordion shaped section 64, a gasket 66, electrical wiring conduits 68, and an air inlet conduit 70 for forced conditioned air. The conditioned air flows from the boot 58 air inlet conduit 70 to the inlet of the duct 44 and then through the duct to the outlets 46 shown in FIG. 1. The conditioned air flows from the outlets 46 through the space between the U-shaped upper section 14 and the semi-flat lower section 16 and the canister 10, directed around the canister by foam baffles mounted on the interior of the cocoon, and then back to the aperture 40 where the conditioned air escapes from the cocoon 12 returning to the ship through the protective boot around the air inlet and cabling. By flowing returned air through the protective boot 58, any air containing mist from the sea is flushed away from the boot 58 interior area. In the prior art, electrical connectors either leaked or sealed in air with some humidity or salt, which would corrode such systems. Protective boot 58 is shaped such that electrical wiring conduits 68 can provide an interface from the canister 10 and launcher electronic components to the existing or modified Mk 41 launch control system.

The four cocoons 12 stacked on the support device 48 in FIG. 2 could be used as a missile launcher. Because of its simplicity and flexibility, missiles stored in the prior art canisters 10, which are housed in the inventive cocoons 12 can be launched on the topside of a ships deck providing an inexpensive means for launching encanistered missiles from a wide variety of ships and locations.

Figure 4:
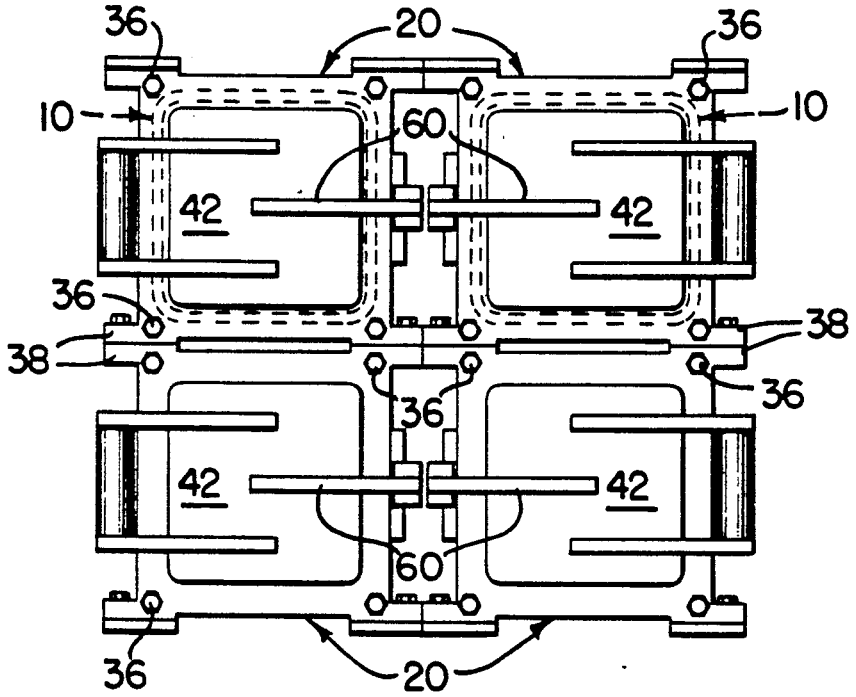
FIG. 4 is a view of the launcher in FIG. 2 along lines 4—4.

FIG. 4 is a view of the launcher in FIG. 2 along lines 4—4. FIG. 4 illustrates how four forward end fixtures 20 are stacked and bolted together when the cocoons 12 are stacked together to form the launcher. A safety latch 60 is provided to prevent the doors 42 from opening before a desired time.

FIG. 5 illustrates another embodiment which yields the launcher in FIG. 2, but uses a different forward end fixture configuration. FIG. 5 would provide a view of the launcher in FIG. 2 along lines 4—4. In this configuration, two forward end fixtures **20*a* are configured as a single unit. The two forward end fixtures are stacked and bolted together when the cocoons 12** are stacked together to form the launcher.

Since the cocoons 12 attached to a boot 58 are weather proof and can be stacked, the cocoons 12 allow the storage of missiles on top of a ship's deck. The cocoons 12 can be stacked several cocoons 12 high on the ship's deck. When launching of the missile is desired the door 42 is opened and the missile is launched. The deflector 30' deflects the exhaust of the missile to keep it from damaging the ship's structure or equipment. The deflector 30' allows a much simpler and less expensive venting of missile exhaust than the prior art Mk 41 vertical launch system. After the missile is launched, the cocoon 12 can be easily disassembled, allowing the removal of the canister 10, and then be reassembled around a new canister 10 with a missile.

Figure 6:
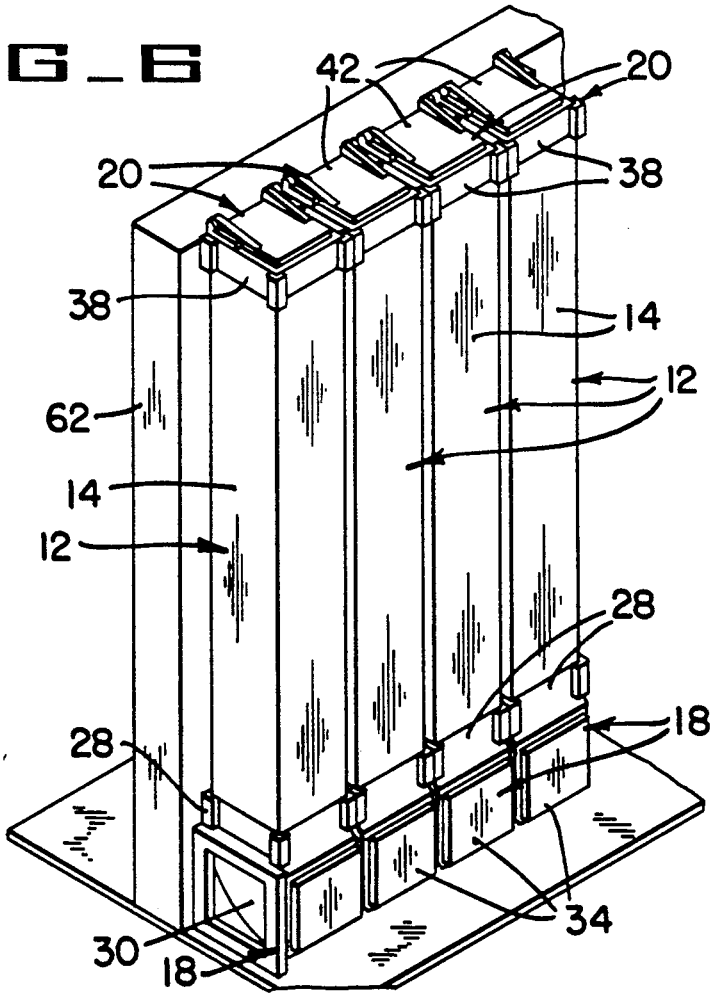
FIG. 6 is a perspective view of another embodiment of a launcher.

FIG. 6 illustrates another configuration of cocoons 12 forming another launcher. In this configuration, the cocoons 12 are placed on a platform 62, which holds the cocoons 12 in a substantially vertical position. In this embodiment, the deflector 30 provides a 90° bend. Boots are not shown, but are utilized to make a complete seal.

While a preferred embodiment of the present invention has been shown and described herein, it will be appreciated that various changes and modifications may be made therein without departing from the spirit of the invention as defined by the scope of the appended claims.

What is claimed is:

1. An apparatus for holding a missile canister containing a missile, comprising:

a cocoon, comprising:

an aft fixture at a first end of the missile canister;

a forward end fixture at a second end of the missile canister;

a U-shaped upper section extending from the aft fixture to the forward end fixture having means for mechanically connecting the aft fixture and the forward end fixture; and a lower section extending from the aft fixture to the forward end fixture having means for mechanically connecting the aft fixture and the forward end fixture.

2. An apparatus, as claimed in claim 1, wherein the cocoon further comprises:

an aperture in the cocoon; and a cocoon conduit with a plurality of outlets.

3. An apparatus, as claimed in claim 2, further comprising, a boot, comprising:

an outer cover of flexible and water proof material forming a tubular shape;

electrical cabling for power and control of the missile functions passing inside of the tubular shape; and an air flow conduit passing inside the tubular shape, wherein the boot is connected to the aperture and the air flow conduit is connected to the inlet of the cocoon conduit.

4. An apparatus, as claimed in claim 3, wherein the aperture and the outer cover form an output conduit for the air flow and wherein part of the outer cover is accordion shaped.

5. An apparatus, as claimed in claim 4, further comprising:

a platform for holding a plurality of cocoons; and support means for holding the platform at a desired angle.

6. An apparatus, as claimed in claim 1, wherein the aft fixture comprises:

a frame, for connecting the aft fixture to the canister;

a deflector; and openable means for venting exhaust from the missile.

7. An apparatus, as claimed in claim 6, wherein the deflector comprises a conduit for venting exhaust from the missile and wherein the conduit has a 45° bend.

8. An apparatus, as claimed in claim 6, wherein the deflector comprises a conduit for venting exhaust from the missile and wherein the conduit has a bend between approximately 45° and 90°.

9. An apparatus for holding a missile canister containing a missile, comprising:

a cocoon, comprising:

an aft fixture at a first end of the missile canister;

a forward end fixture at a second end of the missile canister;

a U-shaped upper section extending from the aft fixture to the forward end fixture, and mechanically connected to the aft fixture and the forward end fixture; and a lower section extending from the aft fixture to the forward end fixture, and mechanically connected to the aft fixture and the forward end fixture, wherein the aft fixture comprises:

a frame, for connecting the aft fixture to the canister;

a deflector; and openable means for venting exhaust from the missile; and wherein the forward end fixture comprises:

a frame, for connecting the forward end fixture to U-shaped upper section and the lower section; and openable means for allowing the missile to exit the canister.

10. An apparatus, as claimed in claim 9, wherein the lower section, comprises:

an aperture; and a conduit with and a plurality of outlets.

11. An apparatus, as claimed in claim 10, wherein the aft fixture further comprises tongues and grooves which mate with the tongues so that the cocoons can be stacked.

12. An apparatus, as claimed in claim 11, wherein the openable means of the aft fixture is a hinged door.

13. An apparatus, as claimed in claim 11, wherein the openable means of the forward fixture is a hinged door.

* * * * *